United States Patent [19]

Ward et al.

[11] Patent Number: 4,486,244

[45] Date of Patent: Dec. 4, 1984

[54] METHOD OF PRODUCING SUPERPLASTIC ALUMINUM SHEET

[75] Inventors: Bennie R. Ward, Richmond, Va.; Suphal P. Agrawal, Rancho Palos Verdes, Calif.; Richard F. Ashton, Richmond, Va.

[73] Assignee: Reynolds Metals Company, Richmond, Va.

[21] Appl. No.: 451,108

[22] Filed: Dec. 17, 1982

[51] Int. Cl.[3] ..... C22F 1/04

[52] U.S. Cl. ..... 148/12.7 A; 420/902

[58] Field of Search ..... 148/12.7 A, 11.5 A, 148/2; 420/902

[56] References Cited

U.S. PATENT DOCUMENTS

| | | | |
|---|---|---|---|
| 3,219,491 | 11/1965 | Anderson et al. | 148/11.5 |
| 3,219,492 | 11/1965 | Anderson et al. | 148/11.5 |
| 3,836,405 | 9/1974 | Staley et al. | 148/12.7 |
| 3,845,551 | 11/1974 | Kunsman | 29/605 |
| 3,847,681 | 11/1974 | Waldman et al. | 148/11.5 A |
| 4,021,271 | 5/1977 | Roberts | 148/2 |
| 4,092,181 | 5/1978 | Paton et al. | 148/12.7 A |
| 4,126,448 | 11/1978 | Moore et al. | 75/146 |
| 4,222,797 | 9/1980 | Hamilton et al. | 148/12.7 A |

*Primary Examiner*—R. Dean

*Attorney, Agent, or Firm*—Alan T. McDonald

[57] ABSTRACT

The use of a sequentially applied warm working/cold working procedure in the conventional steps of preparing heat treatable superplastic alloys yields material which demonstrates substantially equiaxed fine grain structure and improved superplastic forming characteristics.

5 Claims, 6 Drawing Figures

METHOD OF PRODUCING SUPERPLASTIC ALUMINUM SHEET

BACKGROUND OF THE INVENTION

1. Field of the Invention

The present invention relates to superplastic aluminum alloys and particularly to an improved method for producing such materials.

2. Description of the Prior Art

Efforts to produce improved superplastic aluminum alloys, i.e., alloys of aluminum which can be superplastically formed using gas pressure or vacuum have been numerous and extensive as evidenced by the plethora of prior art describing such materials and methods for their preparation.

Among this prior art, two relatively recent techniques appear to produce the most desirable (i.e., commercially valuable) superplastic materials.

The first of these techniques is described in U.S. Pat. No. 3,847,681 issued Nov. 12, 1974, to Waldman et al. This technique, which is presented schematically in FIG. 1 hereof, involves the steps of:

(a) solution heat treating the starting material for from 8–48 hours at a temperature greater than 860° F.;
(b) slow cooling the product of step (a) to an overage temperature, i.e., about 775° F.;
(c) overaging at about 775° F. for 3 to 5 hours;
(d) slow cooling the product of step (c) to a temperature of between about 450°–500° F. and optionally holding at this temperature for up to 4 hours;
(e) plastically deforming the material (from 40–80%) at a temperature between about 450° and 500° F.; and
(f) rapidly recrystallizing at a temperature of between about 800° and 900° F.

This process reportedly provides a fine grain structured 7000 series alloy.

A photomicrograph of 7475 alloy prepared using this procedure is shown in FIG. II. As is clear from this picture, although the grains are relatively fine, their aspect ratio, i.e., length to width ratio, is quite high.

The second prior art process which produces acceptable material is that described in U.S. Pat. No. 4,092,181 issued May 30, 1978 to Paton et al. This patent describes a process for preparing material reportedly of finer grain than that described in the '681 patent, according to a somewhat shorter procedure, and in heat treatable alloys other than those of the '681 patent, which additional alloys may include chromium as an alloying element.

The process of the '181 patent is quite similar to that of the '681 patent except that it offers the option of cold water quenching after solution heat treat and before overage (i.e., between steps (a) and (c) of '681) and eliminates the need entirely for the optional soaking or holding of step (d) of the '681 patent.

In each of these references, the mechanical work required to induce the lattice strain necessary for recrystallization is performed while the material is warm, i.e., at between 400° and 650° F. Although the '181 patent alludes to the feasibility of performing such work at lower temperatures, i.e., "below the overage temperature" there is no disclosure of "cold" rolling, i.e., rolling at room temperature.

Both of the foregoing processes provide useful superplastic materials as evidenced by evaluation thereof by the inventors of the present process. These prior art processes are, however, somewhat difficult to work into a commercial production operation because of the apparent requirement that substantially all of the mechanical work be accomplished in a hot or warm condition.

The term "and/or" as used herein is meant literally, i.e., when referring to the use of steps A and/or B, is meant using A and B, or B alone, but not A alone.

The advantages of fine and equiaxed grain structure in superplastic materials are discussed in detail in "Superplasticity", J. W. Edington, K. N. Melton and C. P. Cutler, *Progress in Materials Science,* vol. 21, No. 2, pp. 63–170, Pergamon, N.Y. (1976).

SUMMARY OF THE INVENTION

According to the present invention, it has been found that substantially improved superplastically formable materials, i.e., materials having a fine (<20 μm) and equiaxed grain structure, can be produced by a process which is substantially more commercially acceptable when the mechanical working is achieved either entirely in the cold state or partially warm and partially cold.

DESCRIPTION OF THE DRAWINGS

FIG. I is a graphic representation of the process described in U.S. Pat. No. 3,847,681.

FIG. II is an enlarged photomicrograph of superplastic 7475 alloy prepared according to the process of U.S. Pat. No. 3,847,681.

Figure 1:
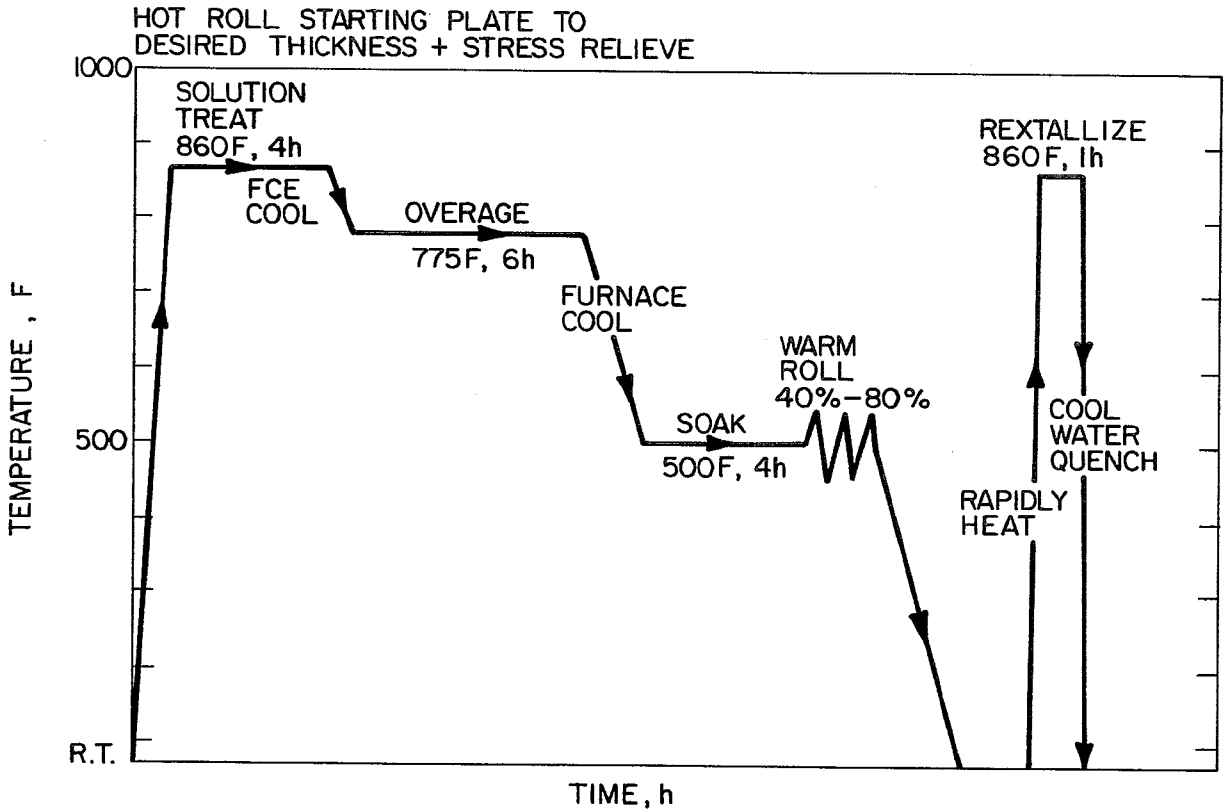
Figure 4:
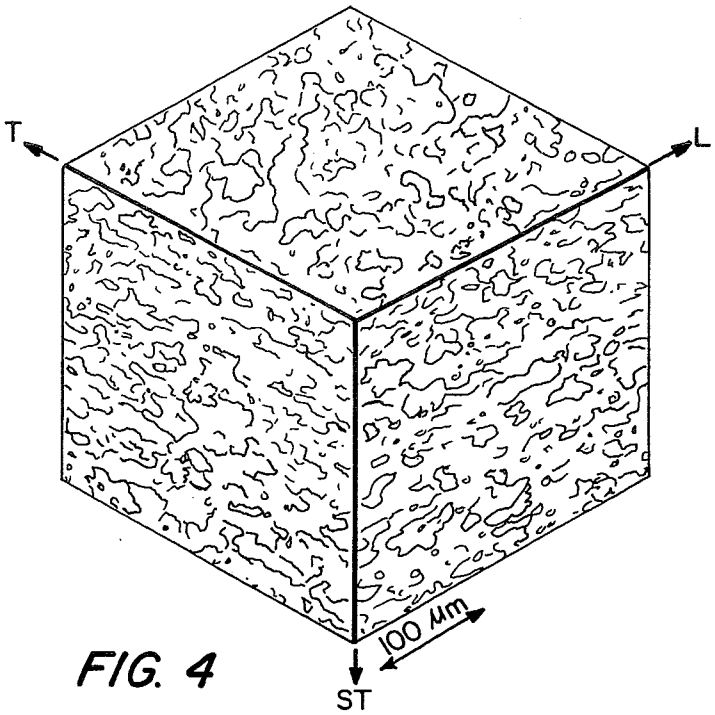
Figure 2:
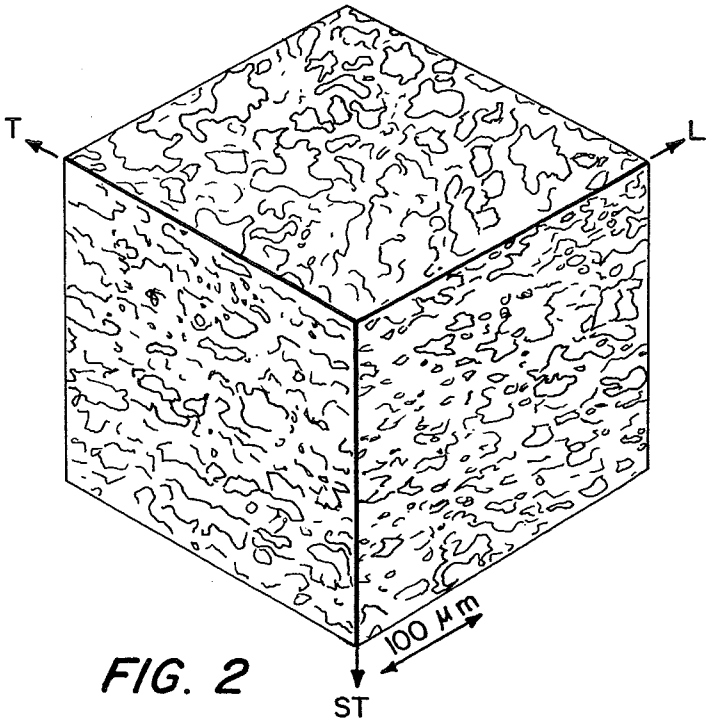
Figure 3:
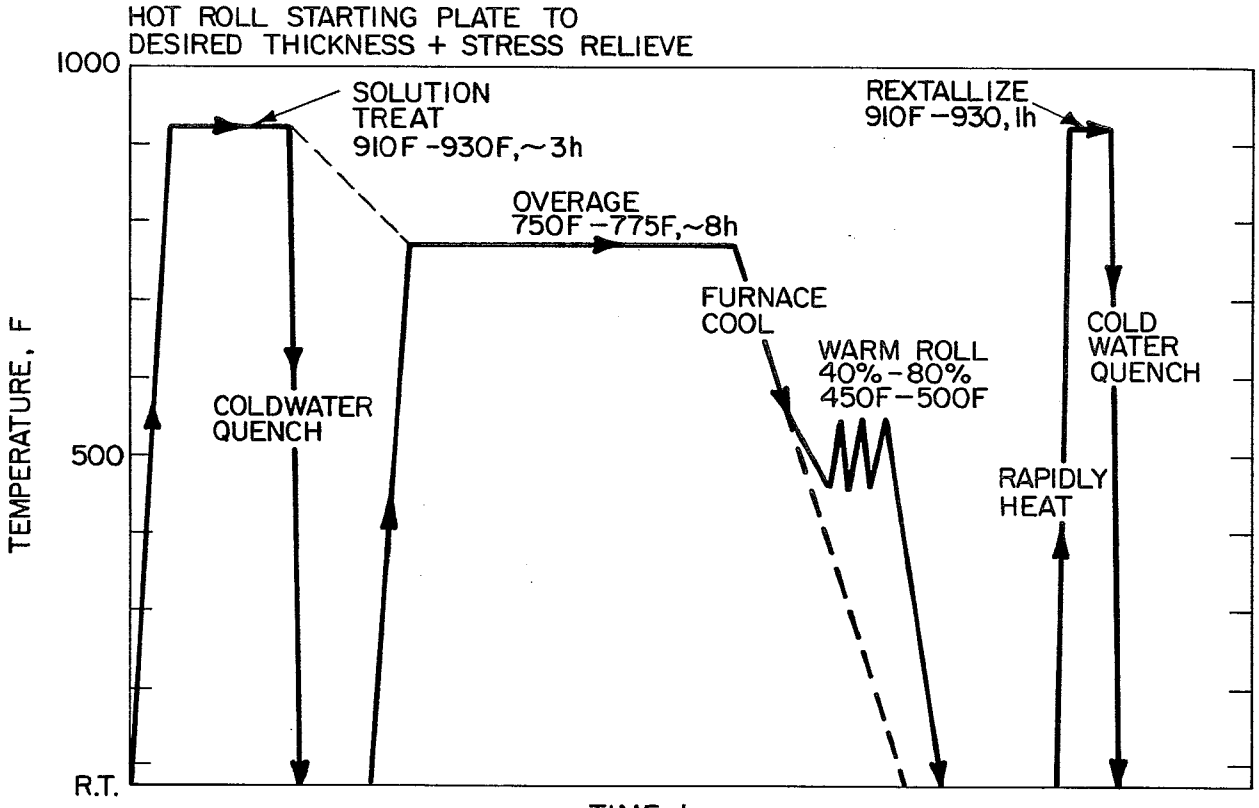
Figure 5:
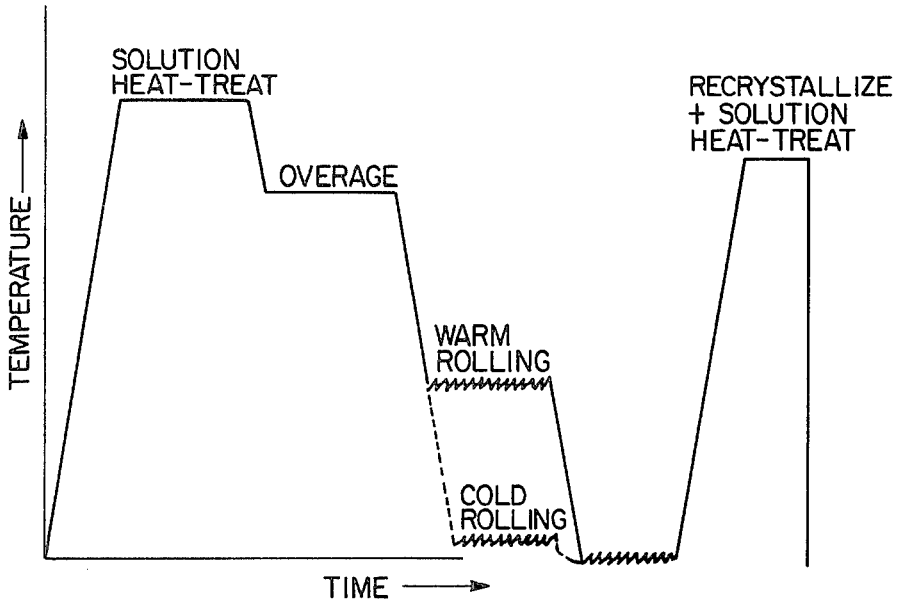
Figure 6:
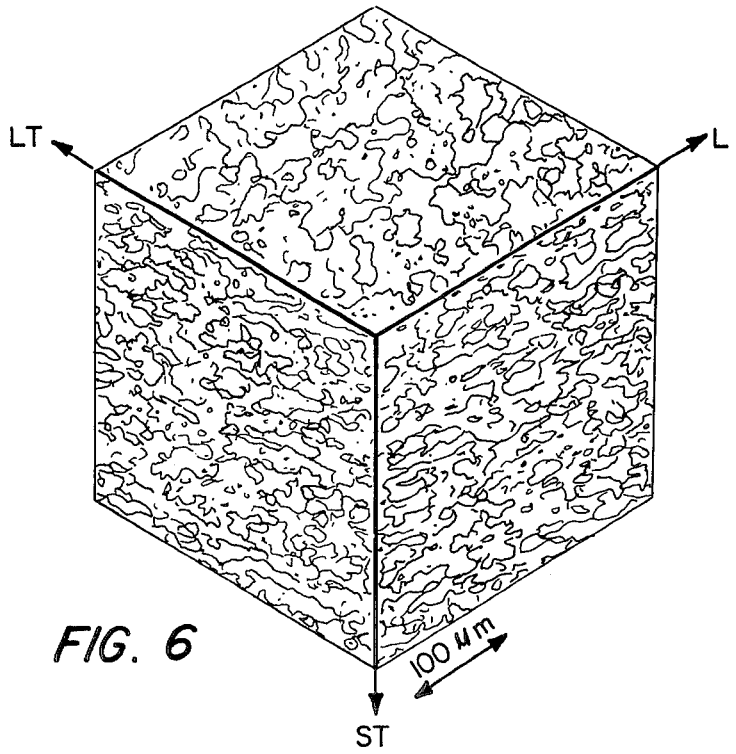

FIG. III is a graphic representation of the process described in U.S. Pat. No. 4,092,181.

FIG. IV is an enlarged photomicrograph of superplastic 7475 alloy prepared according to the process of U.S. Pat. No. 4,092,181.

FIG. V is a graphic representation of the process of the present invention.

FIG. VI is an enlarged photomicrograph of superplastic 7475 alloy prepared according to the process of the present invention.

This invention consists of a method for producing superplastic aluminum sheet, which method is readily practiced in a plant environment. This method is applicable to heat-treatable alloys, particularly those of the 7000 series. When aluminum sheet has been processed according to the present invention, very large amounts of plastic deformation from 50% to several hundred percent can be obtained to produce complex parts which would normally be produced by joining several parts formed by conventional processes.

The general time-temperature cycles necessary to accomplish the invention are shown in FIG. V. The processing sequence consists of solution heat-treating, overaging, warm and/or cold working, followed by recrystallizing. The correct combination of these process steps will result in a product with an equiaxed, fine grained (<20 μm) microstructure, which is capable of exhibiting superplastic behavior at elevated temperatures.

The alloys used in the work described herein were conventionally produced 7075, 7475, 7050, and X7091 (P/M). All have shown superplastic capabilities as a result of the time/temperature treatment taught by this invention. The alloy found to be superior in its superplastic performance was 7475, and our discussion of the details of the fabrication practice will deal primarily with this alloy, although similar practices can be applied to all the above-mentioned alloys as well as to other heat-treatable aluminum alloys, including, but not limited to X2034, 2219, 2124 and 2014.

SOLUTION HEAT-TREATING

The solution heat-treating step involves heating the starting plate to a high enough temperature so as to dissolve the normally soluble phases. This treatment will not take into solution the insoluble or dispersoid particles; therefore, it is best to start with an alloy that is low in alloying impurities such as iron and silicon. Heat-treating in the range of from about 860° to about 925° F. has been found satisfactory. The upper limit of this temperature range is dictated by the initiation of melting. The time of treatment in this temperature range varies from about ¼ to about 48 hours. After solutioning of the precipitate, the plate is then cooled directly to aging temperatures. Alternately, the material could be rapidly quenched to room temperature and then reheated to the aging temperature, as taught in U.S. Pat. No. 4,092,181. Experiments have shown, however, that this rapid quench practice is not necessary. A direct cool to the overaging temperature was found to yield a more equiaxed microstructure with finer grains, which are essential to improved superplastic response. Plates with thicknesses from 0.25" to 1.50" can be processed into sheets of various gauges using this practice.

OVERAGING

Overaging is accomplished by cooling the material to below the solid solution temperature (solvus) for a sufficient time to allow precipitates to nucleate and grow throughout the metal matrix. These precipitates, formed in the overaging step, act as grain nucleation sites after the material has been warm and/or cold rolled and recrystallization heat-treated. The size and distribution of these precipitates, along with the amount of rolling, are the governing factors that determine the grain size and shape in the superplastic sheet. The amount of rolling provides the driving force for nucleation of strain-free new grains and an optimum size and distribution of precipitates is necessary to ensure that these new grains will be equiaxed and remain small.

The preferred overaging practice is performed at temperatures of from about 675° to about 775° F. for a period of from about 2 to about 8 hours. Cooling rates varying from about 100° F./hour to about 25° F./hour have been found useful. The range of gauges of material demonstrating useful results is as that described above for the solution heat-treating practice results.

WARM AND/OR COLD WORKING

After the proper precipitate size and distribution have been achieved during the overaging step, the material is plastically deformed by rolling at an elevated and/or ambient temperature to impart sufficient strain energy to cause recrystallization during recrystallization heat-treating. This is another major area which distinguishes the process of the present invention from the prior art and where the resultant practice is one that lends itself to commercial production. To eliminate the problems of edge cracking when imparting high levels of work (>60%) into 7XXX sheet, it has been taught to warm roll the material at 500° F. Even though warm rolling reduces the tendency to edge crack, it is difficult for a plant to warm roll sheet to thin gauges (for example, 0.060"). We have found that if the cracked edges are trimmed off after about 60% cold work, the material can then be further cold rolled to the final gauge without difficulty and without any substantial propagation of edge cracks.

RECRYSTALLIZATION HEAT-TREATING

After achieving the proper precipitate size and distribution and introducing sufficient strain energy by warm and/or cold rolling to cause recrystallization under proper conditions (as well as to reduce the gauge thickness to the desired amount), a recrystallization heat treatment operation is performed. This consists of a rapid heating of the material to a high enough temperature so as to activate the recovery and recrystallization processes to nucleate new grains. However, the time and temperature conditions are such that any substantial grain growth is avoided. A proper precipitate size and distribution (obtained during the overaging treatment) aids in pinning grain boundaries so that fine and equiaxed grains are created, which grains are stable during superplastic forming. Rapid heating to from about 860° to about 925° F. has been found satisfactory. As in initial solution heat treating, the upper limit of the temperature range is dictated by the initiation of melting. The time of treatment in the temperature range varies from about 10 minutes to about 2 hours for sheets in the thickness range of from 0.060 in. to 0.125 in.

Using the foregoing method superplastic 7475 sheet in final gauges of from about 0.125" to about 0.060" can be produced, employing various amounts of rolling (warm and/or cold) of from about 64% to as high as about 91%.

We have found that to produce thin (0.060") superplastic sheet, we can subject the plate to the superplastic thermal treatment (i.e., the initial solution treatment and the overaging treatment) at 0.250" thickness and cold roll to the desired gauge. Thicker or thinner gauges than 0.250" can be used, depending on coiling equipment capability and the amount of cold rolling desired. For simplicity and reference this process is referred to herein as the "coil practice".

To produce the thicker (>0.060") superplastic sheet, we have developed a different method in order to impart sufficient strain energy. This method uses both warm and cold rolling and is referred to herein as the "plate method." In this practice, the superplastic thermal treatment is employed at a gauge greater than about 0.250". After the material has been overaged, it is allowed to cool to 500° F., where it is rolled at that temperature to an intermediate gauge defined by example hereinafter. At that gauge it is cooled to room temperature and cold rolled to the desired final gauge. This latter cold rolling may be in a direction tranverse to that of the warm rolling. In fact, there is some evidence at this time that such "transverse" cold rolling will result in a more equiaxed grain structure than warm and cold rolling in the same direction.

All the variations of solution heat-treating, overaging, rolling, and recrystallization heat-treating which comprise the necessary steps to produce superplastic sheet can be divided into the aforementioned two broad categories, i.e., the "plate practice" and the "coil practice". The "plate practice" involves both warm and cold rolling of thick plate. The advantage of this method is that many varied gauges of superplastic sheet can be made by this practice. The "coil practice" uses only cold rolling and it is used to produce thin gauge (≦0.060") superplastic sheet. This practice lends itself more readily to a plant production schedule where an ingot can be hot rolled to a coiling gauge, coiled, solution heat-treated, overaged, cooled to room temperature, rolled to the final gauge, and recrystallization heat-treated in a continuous heat-treating line operation.

EXAMPLES

Example 1—Plate Practice

7475-F plates 14" wide and 1.50" thick were preheated to 750° F. and hot rolled to a gauge of 0.625" on a reversing 4-high mill (18" wide, 8" diameter work roll, 20" backup roll), with reheats when the temperature reached 600° F. The metal was then solution heat-treated in an air circulating furnace (4'×3'×3' inside dimensions) at 900° F. for 2 hours, cooled 50° F. per hour to 775° F., held 4 hours at this temperature, cooled 50° F. per hour to 500° F., and held 4 hours at this temperature. The metal was then warm rolled at a temperature of about 500° F. to 0.250". The rolling was done with ⅛" bites with a 15-minute reheat at 500° F. between each bite. The 0.250" plate was then cooled to room temperature and cold rolled to the desired gauge. For this experiment the gauges were 0.125" (80% total reduction), 0.090" (85.6% total reduction), and 0.060" (90.4% total reduction). During the cold rolling, any edge cracking that appeared was sheared off before it had a chance to propagate. All final sheets were then recrystallization heat-treated in an air circulating furnace for 30 minutes at 900° F., cold water quenched, and roller leveled. Samples were cut for grain size determination, and the various sheets subsequently tested for superplastic formability potential. The results of these tests are shown in Tables I and II, respectively.

Example 2—Coil Practice

7475-F plates 14" wide and 1.50" thick were preheated to 750° F. and hot rolled on a 4-high mill, with reheats when the temperature reached 600° F., to a gauge of 0.290". The metal was then solution heat-treated at 900° F. for 2 hours, cooled 50° F. per hour to 775° F., held 4 hours, cooled 50° F. per hour to 500° F., held 4 hours, and then cooled to room temperature. The 0.290" plate was then cold rolled on the 4-high mill to the desired gauge of 0.060". During the cold rolling, the edge cracking was trimmed by shearing as in Example 1. The 0.060" sheet was then recrystallization heat-treated for 30 minutes at 900° F., cold water quenched, and roller leveled. Samples were used for grain size determination, and larger sheet coupons tested for superplastic formability potential. The results of these tests are shown in Tables I and II, respectively.

The materials produced in Examples I and II were superplastically tested at elevated temperatures in the range of 920° F. to 980° F. Preliminary formability tests in this temperature range showed that the various sheet materials produced exhibited superplasticity in the entire temperature range although their best superplastic behavior was in the range of from about 960° F. to about 980° F. Consequently, the bulk of the testing was conducted in this (960° F. to 980° F.) temperature range. An elevated temperature "cone test" was employed to determine the material flow parameters. This test comprises biaxial forming of cone shaped specimens rather than by the uniaxial tension test of sheet coupons as is conventionally performed. The main reason for use of this testing method is to ensure that the test methods employed can measure true material superplasticity in the high-strength aluminum alloys without being affected by other phenomena occurring in these alloys which may influence their superplastic ductility. Based upon experience, the high-strength aluminum alloys fail during the superplastic deformation by a mechanism involving cavity initiation at interfaces such as grain boundaries and cavity growth with increasing superplastic strain rather than by the classical mechanism of necking from strain localization (as in Ti-6Al-4V and other titanium alloys). An elevated-temperature uniaxial tension test performed on the strips of these aluminum alloys without suppression of cavitation results in a mixed-mode failure (that due to necking as well as due to cavitation) and thus does not measure true material superplasticity (that due to necking alone by strain localization). A biaxial and/or plane-strain type test by forming a sheet coupon into controlled geometries with the aid of a dual pressurization technique (which suppresses cavitation during SPF deformation) will provide a better measure of material superplasticity, since the results are not influenced by caviation and failure occurs primarily by necking alone due to strain localization. Furthermore, the equivalence of the elevated-temperature uniaxial tensile data to those obtained by the elevated-temperature biaxial (cone-type) forming methods has been demonstrated on previous U.S. Air Force (Wright Aeronautical Laboratories) sponsored research and development programs (see, for example, technical report AFWAL-TR-80-4038 "Metallurgical Characterization of Superplastic Forming," T. L. Mackay, et al., September 1980). Thus, in the absence of cavitation, cone-type biaxial forming (or a plane-strain trough forming) method is generally equivalent to the uniaxial tensile testing method. Indeed, simple forming type tests are often preferable in a production manufacturing environment because of their being lower cost and providing closer simulation of the actual forming conditions. Thus, biaxial and/or plane-strain forming type testing methods are as valid as the uniaxial tensile testing methods for obtaining material superplasticity parameters, and are particularly preferable in testing high-strength aluminum alloys whose superplasticity is significantly affected by cavitation.

The flow parameters determined from the cone tests conducted on the various sheets are shown in Table II and were: the flow stress ($\sigma$), and the strain-rate sensitivity of the flow stress(m). The flow stress is a measure of the inherent resistance of the material to deformation; therefore, the lower the value of the flow stress, the easier it will be to superplastically form the material. The minimum value of the flow stress is the yield strength of the material at the test temperature. The "m" value is a measure of the inherent superplastic (neck-resistant) ductility in the material; therefore, the higher the "m" value of the given material, the more capability it will have of being superplastically formed into large uniform strains. The maximum possible value of m in metals is just below 1. Values of $m \geqq 1$ are achieved when the material is in a glassy or Newtonian viscous state and it is no longer solid state.

In addition to the values of $\sigma$ and m, maximum elongation before failure is also determined from the cone tests. All of these parameters are dependent on strain rate and are, therefore, determined at constant values of strain rate. Table II shows the values of these parameters in the 960° F. to 980° F. temperature range. Also shown here for comparison are typical values for other materials at optimum temperatures for superplasticity.

The results presented in Table II clearly show the improvement in the superplastic performance of the 7XXX alloy sheet prepared according to the process described herein. It is also seen from these data that the material produced by the method of this invention compares favorably with the Ti-6Al-4V alloy which is commonly known for its superplastic performance.

TABLE I

Examples of Grain Sizes Obtained in Various Experimental Sheets of Alloy 7475 (Linear Intercept Method)

| Method | Final Gauge (in.) | Direction | G/MM2 | ASTM Grain Size | Avg. Grain Dia. μm | Std. Dev. μm | Aspect Ratio+ |
|---|---|---|---|---|---|---|---|
| Plate | 0.060 | Center Longitudinal | 4297 | 9.1 | 15.2 | 0.7 | 2.2 |
| | | Edge Longitudinal | 6123 | 9.6 | 12.9 | 1.4 | 1.8 |
| | | Transverse | 5570 | 9.5 | 13.4 | 0.3 | 1.7 |
| Plate | 0.090 | Center Longitudinal | 3837 | 8.9 | 16.4 | 2.1 | 2.2 |
| | | Edge Longitudinal | 4103 | 9.0 | 15.6 | 0.8 | 2.2 |
| | | Transverse | 4927 | 9.3 | 14.1 | 1.5 | 1.7 |
| Plate | 0.125 | Center Longitudinal | 3257 | 8.7 | 17.6 | 1.4 | 2.4 |
| | | Edge Longitudinal | 4071 | 9.0 | 15.7 | 0.5 | 2.0 |
| | | Transverse | 3462 | 8.7 | 17.6 | 2.8 | 1.9 |
| Coil | 0.060 | Center Longitudinal | 3776 | 8.9 | 16.3 | 0.8 | 2.2 |
| | | Edge Longitudinal | 4447 | 9.2 | 15.2 | 0.9 | 2.3 |
| | | Transverse | 4270 | 9.1 | 15.3 | 0.8 | 2.0 |

+Aspect ratio is the ratio of long dimension of the grain divided by the short dimension. A ratio of 1 is obtained for a completely equiaxed (spherical) grain.

*It is evident that the materials produced are well within the established goal of producing a mill-type material with a grain size of less than 20 micrometers.

TABLE II

Elevated-Temperature Superplasticity Parameters for Various Structural Materials

| Method | Gauge Thickness (inch) | Strain Rate ($sec^{-1}$) | $m_{max}$ | σ (Psi) | Elongation To Fracture(1) (%) |
|---|---|---|---|---|---|
| 7475 Aluminum Material Produced by Methods of This Invention | | | | | |
| Plate(2) | 0.060 | $3.0 \times 10^{-4}$-$7.0 \times 10^{-4}$ | 0.91 | 400-900 | 370-410 |
| Plate(2) | 0.090 | $8.0 \times 10^{-5}$-$4.0 \times 10^{-4}$ | 0.66 | 300-800 | 365 |
| Plate(2) | 0.125 | $4.0 \times 10^{-5}$-$2.0 \times 10^{-4}$ | 0.66 | 200-600 | — |
| Coil(2) | 0.060 | $1.5 \times 10^{-4}$-$7 \times 10^{-4}$ | 0.59 | 450-1100 | 105 |
| Coil(3) | 0.060 | $5 \times 10^{-4}$-$1.1 \times 10^{-3}$ | 0.79 | 450-850 | 185 |
| Available Values for Other Materials | | | | | |
| Ti-6Al-4V | 0.060-0.125 | $5 \times 10^{-4}$ | 0.9 | 1100-1500 | 600-700 |
| 7075 Al | 0.060 | $1 \times 10^{-4}$ | 0.2-0.3 | 1500-2000 | 100 |

Notes:
(1)Elongation to fracture was determined only at the highest rate in the given range of strain rates.
(2)All these sheets were produced from the same initial 7475 plate.
(3)This sheet was produced from a 7475 plate of different composition.

We claim:

1. In a method for producing superplastic aluminum sheet having a fine (<20 μm) and equiaxed grain structure comprising the steps of:
   (a) providing an aluminum alloy plate of appropriate composition and desired thickness by hot rolling and stress relieving;
   (b) solution heat treating the plate at a temperature higher than 860° F. for from about ¼ to 48 hours;
   (c) slow cooling the product of step (b) to an average temperature of about 775°;
   (d) overaging at about 775° F. for from about 2 to 8 hours;
   (e) slow cooling the product of step (d) to a temperature of between about 450° to about 500° F. and optionally holding this temperature for up to about 4 hours;
   (f) plastically deforming the product of step (e) from about 40 to about 80%; and
   (g) rapidly recrystallizing at a temperature of between about 800° and 900° F., the improvement which comprises performing a first portion of the plastic deformation of step (f) by warm rolling at a starting temperature of between about 450° to about 500° F. and performing a second portion of the plastic deformation of step (f) by cold rolling at room temperature, said cold rolling being performed in a direction transverse to said warm rolling.

2. The method of claim 1 wherein the solution heat treating of step (b) is performed at a temperature of between about 860° and about 925° F. and for from about ¼ to about 24 hours.

3. The method of claim 1 wherein the overaging of step (d) is performed at a temperature of between about 675° and about 775° F. for a period of from about 2 to about 8 hours.

4. The method of claim 1 wherein the aluminum alloy plate comprises an alloy selected from the group consisting of 7075, 7475, 7050, X7091, X2034, 2219, 2124 and 2014.

5. In a method of imparting a fine (<20 μm) and equiaxed grain structure to an aluminum alloy having a precipitating constituent, comprising the steps of:
   (a) dissolving at least some of the precipitating constituent by heating the alloy to solid solution temperature;
   (b) cooling the alloy to a temperature below the solid solution temperature;
   (c) plastically straining the alloy; and
   (d) recrystallizing the alloy, the improvement comprising performing the plastically straining of step (c) by sequentially warm rolling at a starting temperature of between about 450° to about 500° F. and cold rolling at room temperature, said cold rolling being performed in a direction transverse to said warm rolling.

* * * * *